United States Patent [19]

Watanabe et al.

[11] 4,445,821

[45] May 1, 1984

[54] CENTRIFUGAL PUMP HAVING MEANS FOR COUNTERBALANCING UNBALANCED FLUID PRESSURE RADIAL FORCES ON ROTOR

[75] Inventors: Kiyohiko Watanabe, Chiryu; Kazuma Matsui, Toyohashi; Yoshiyuki Hattori, Toyoake; Toshihiro Takei, Kariya; Toshiaki Nakamura, Anjo; Shunsaku Ohnishi, Toyota, all of Japan

[73] Assignee: Nippondenso Co., Ltd., Kariya, Japan

[21] Appl. No.: 372,169

[22] Filed: Apr. 26, 1982

[30] Foreign Application Priority Data

Apr. 27, 1981 [JP] Japan ..... 56-63568

[51] Int. Cl.[3] ..... F04B 39/06; F04B 35/04; F04D 5/00

[52] U.S. Cl. ..... 417/366; 417/423 R; 415/53 T; 415/213 T

[58] Field of Search ..... 415/53 T, 213 T, 198.2; 417/357, 366, 410, 423 R; 418/126

[56] References Cited

U.S. PATENT DOCUMENTS 2,704,516 3/1955 Mock et al. ..... 417/423 R
3,119,343 1/1964 White ..... 415/213 T
3,418,991 12/1968 Shultz et al. ..... 417/423 R
3,995,975 12/1976 Bosch ..... 418/126

*Primary Examiner*—William L. Freeh
*Assistant Examiner*—Paul F. Neils
*Attorney, Agent, or Firm*—Cushman, Darby & Cushman

[57] ABSTRACT

A fuel pump apparatus has an electric motor and a regenerative pump having a pump housing and an impeller rotated by the motor shaft journalled by a bearing to the pump housing. The impeller is operative to produce in the pump housing a fluid pressure which is unbalanced in the circumferential direction of the impeller and forms circumferentially unbalanced radially inward forces the resultant force of which is applied through the impeller to a first side of the peripheral surface of the shaft. The discharge port of the pump is open to the interior space within the motor. An opening is formed in the bearing and has an inner end faced to a second side of the peripheral surface of the motor shaft substantially diametrically opposite to the first side, whereby the discharge pressure of the pump is applied through the motor interior space and through the opening in the bearing to the second side of the motor shaft to counterbalance to the resultant force of the circumferentially unbalanced radially inward forces applied to the motor shaft.

4 Claims, 6 Drawing Figures

CENTRIFUGAL PUMP HAVING MEANS FOR COUNTERBALANCING UNBALANCED FLUID PRESSURE RADIAL FORCES ON ROTOR

BACKGROUND OF THE INVENTION

1. Field of the Invention

The present invention relates to a pump apparatus of the kind that comprises a pump including an impeller or rotor and a driving means such as an electric motor for rotating the impeller or the rotor.

2. Description of the Prior Art

In the pump apparatus of the kind specified above, the impeller or rotor is subjected to a radially inward fluid pressure which is unbalanced in the circumferential direction of the impeller or rotor for the reason to be described later in connection with the accompanying drawings. The circumferentially unbalanced radially inward fluid pressure forms a circumferentially unbalanced radially inward force which is applied through the impeller or rotor to one side of the peripheral surface of the motor shaft on which the impeller or rotor is mounted. Thus, the friction between the motor shaft and a bearing therefor is increased with a resultant increase in the friction-loss torque, in the reduction in the efficiency of the pump and, further, in the decrease of the durability of the pump. If the bearing section of the pump is worn due to the operation of the pump for a long time, the pump impeller or rotor would be offset from its initial or original parallel relationship to the mating inner surfaces of the pump housing with a resultant problem that the discharge pressure of the pump is pulsated and the pump operation produces noise.

SUMMARY OF THE INVENTION

It is an object of the present invention to provide an improved pump apparatus which is free from the problem discussed above.

The pump apparatus according to the present invention comprises a pump means including a pump housing, a shaft and a rotary pumping member rotatably disposed in the pump housing and mounted on the shaft for rotation therewith. The pump housing is formed therein with suction and discharge ports. A driving means is drivingly connected to the shaft to rate the rotary pumping member for pumping a fluid. A bearing means rotatably supports the shaft adjacent to the rotary pumping member. The pump means is operative to produce in the pump housing a radially inward fluid pressure which is unbalanced in the circumferential direction of the rotary pumping member and which forms circumferentially unbalanced radially inward forces the resultant force of which is applied through the rotary pumping member to a first side of the peripheral surface of the shaft. The pump apparatus is provided with counterbalancing means including a pressure introducing opening formed in the bearing means and having an inner end faced to a second side of the peripheral surface of the shaft substantially diametrically opposite to the first side of the shaft. The counterbalancing means further includes means establishing a fluid-flow communication between the discharge port of the pump housing and the pressure introducing opening in the bearing means whereby the discharge pressure of the pump means is applied to the second side of the shaft to form a force counterbalancing to the resultant force of the circumferentially unbalanced radially inward forces.

As such, the counterbalancing force applied by the discharge pressure of the pump through the pressure introducing opening in the bearing to the second side of the shaft is effective to cancel the circumferentially unbalanced radially inward forces applied to the shaft by the fluid pressure within the pump housing to thereby assure that the bearing section of the pump apparatus is free from the circumferentially unbalanced radially inward forces with a resultant decrease in the friction-loss torque, in the increase in the efficiency of the pump apparatus and in an improvement in the durability of the pump apparatus.

The above and other objects, features and advantages of the present invention will be made more apparent by the following description with reference to the accompanying drawings.

DESCRIPTION OF PREFERRED EMBODIMENT

Figure 1:
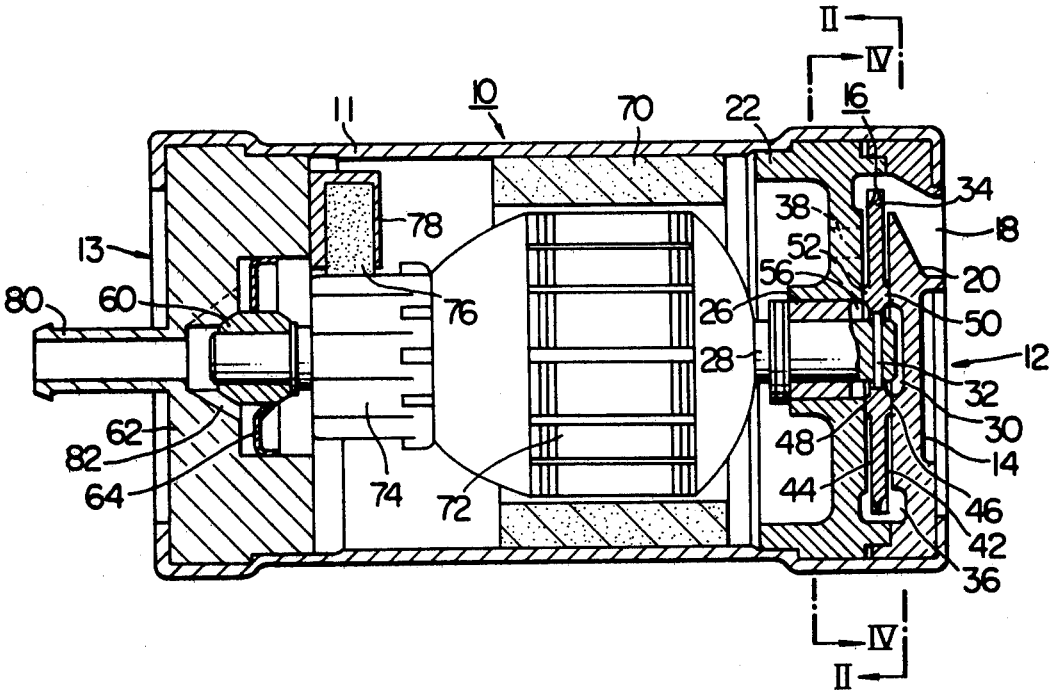
FIG. 1 is an axial sectional view of an electrically operated fuel pump embodying the present invention.
Figure 2:
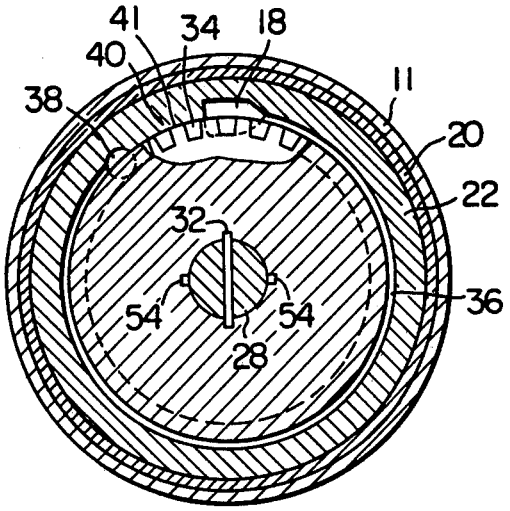
FIG. 2 is a cross-sectional view of the fuel pump shown in FIG. 1 taken substantially along line II—II in FIG. 1.

Referring to FIGS. 1 and 2, an electrically operated fuel pump apparatus is generally designated by 10 and includes a casing 11 which houses therein a pump 12 and an electric motor 13. The pump 12 comprises a pump housing 14 and a disc-like impeller 16 rotatably mounted therein. The pump housing 14 comprises an outer section 20 formed therein with a suction port 18 and constituting an end wall of the casing 11 of the pump apparatus 10 and an inner section 22 secured to the outer section 20.

The inner section 22 of the pump housing 14 also acts as a holder for supporting a bearing 26 for the motor 13. The motor has a shaft 28 extending through the bearing 26 and having an outer end extending into a recess 30 formed in the central area of the inner surface of the outer section 20 of the pump housing 14.

The impeller 16 is mounted on the shaft for rotation therewith and for axial sliding movement thereon. The shaft 28 carries thereon a transverse pin 32 which transmits the torque of the shaft 28 and thus of the motor 13 to the impeller 16. The impeller is provided with circumferential rows of circumferentially spaced radial vane grooves 34 formed in the opposite end faces of the impeller adjacent to the outer periphery thereof so that the vane grooves operate to pump the fluid. The grooved outer marginal section of the impeller 16 and the pump housing 14 cooperate together to define a circumferential fluid passage 36 which is communicated not only with the suction port 18 but also with a discharge port 38 formed in the inner section 22 of the pump housing. As will be seen in FIG. 2, the suction and discharge ports 18 and 38 are spaced circumferentially of the impeller 16. The pump housing inner section 22 has an integral portion 40 which extends into the circumferential fluid passage 36 between the suction and discharge ports 18 and 38 to form a circumferential partition, as will be seen in FIG. 2. In other words, the circumferential fluid passage 36 is circumferentially interrupted by the partition 40.

The pump 12 is of the type that is so-called "regenerative pump" which is designed to produce such a high discharge pressure as is required for a fuel pump used in an electronically controlled fuel injection system. For this purpose, the pump 12 is provided with first set of sealing sections 42 and 44 formed between the opposite end faces of the impeller 16 and the adjacent inner surfaces of the pump housing 14. The sealing sections are disposed between the grooved outer marginal section of the impeller 16 and the central area thereof. The clearance or gaps between the impeller end faces and the pump housing at the sealing sections 42 and 44 are usually as small as from 30 to 60 microns but are exaggerated in the drawings.

In addition to the first set of sealing sections 42 and 44, the pump apparatus 10 is provided with a second set of sealing sections 46 and 48 disposed radially inwardly of the first set of sealing sections 42 and 44 as well as to prevent the impeller from being unduly shifted in one axial direction and being damaged at the grooved outer marginal section. For this purpose, the clearances between the impeller 16 and the housing inner surfaces at the second set of sealing sections 46 and 48 are smaller than those at the first set of sealing sections 42 and 44, namely, less than 30 microns. In the embodiment of the invention illustrated in FIG. 1 of the drawings, the second set of sealing sections 46 and 48 are formed by the cooperation of the inner surfaces of the pump housing directed to the impeller end faces and annular projections 50 and 52 formed on the opposite end faces of the impeller between the first set of sealing sections 42 and 44 and the central section of the impeller.

The circumferential partition 40 forms a third sealing section 41 providing a seal between the pump housing and the grooved marginal section of the impeller and between the suction and discharge ports 18 and 38.

The impeller 16 is provided with a plurality of axial communication passages 54 constituted by grooves formed in the inner peripheral surface of the shaft hole in the impeller so that the fluid pressures on both sides of the impeller, namely, the fluid pressure in the recess 30 and the fluid pressure in the space 56 defined between the bearing 26 and the impeller 16, are balanced or equalized. Due to the pressure-equalizing function of the communication passages 54, the clearances between the impeller 16 and the housing inner surface at the second set of sealing sections 46 and 48 are substantially equalized to facilitate smooth rotation of the impeller.

With respect to the motor 13, it has been described that the impeller 16 of the pump 12 is mounted on one end of the shaft 28. The other end of the shaft 28 is journalled by a second bearing 60 which in turn is mounted by a rocking washer 64 on the other end wall 62 of the casing 11 (it has been described that one end of the casing is formed by the outer section 20 of the pump housing 14). The end wall 62 forms a bearing holder and is fitted into the end of the pump casing 11 remote from the pump 12. Permanent magnets 70 are secured to the inner peripheral surface of the casing 11 by any conventional securing means. An armature 72 is mounted on the shaft 28 and aligned with the magnets 70. A commutator 74 is mounted on the shaft 28 adjacent to the armature 72. A brush 76 is mounted by a brush holder 78 on the bearing holder 62. A fuel delivery port 80 is formed centrally of the bearing holder 62 while fuel discharge passages 82 are formed in the end wall or bearing holder 62 around the bearing 60 to provide communication between the fuel delivery port 80 and the space within the motor 13.

The fuel pump 10 of the construction and arrangement described is usually installed in a fuel tank of a vehicle.

In operation, when the brush 76 is supplied with an electric current, the armature 74 is rotated with the shaft 28 and the impeller 16, so that fuel is sucked through the suction port 18 into the circumferential fluid passage 36 and pressurized to a pressure level of from about 3 to about 4 kg/cm$^2$ and then discharged through the discharge port 38 into the space within tne motor 13. The fuel then flows through the space between the armature 72 and the magnets 70 while cooling the armature and is then discharged through the discharge passages 82 and the delivery port 80 into a conduit (not shown) connected to the port 80 so that the pressurized fuel is fed to fuel injectors (not shown) mounted on an engine.

In the pump apparatus 10 having the described structure and function, when the operation of the pump 12 has been started and the discharge pressure of the pump has been increased to a level obtained from normal pump operation, it has been known from a literature that the pressure within the circumferential fluid passage 36 is increased from the suction port 18 toward the discharge port 38 substantially in proportion to the length of the circumferential fluid passage 36. On the other hand, the fluid pressure along the third sealing section 41 is considered to be lowered from the discharge port 38 to the suction port 18 substantally in proportion to the circumferential length of the sealing section 41.

Figure 3:
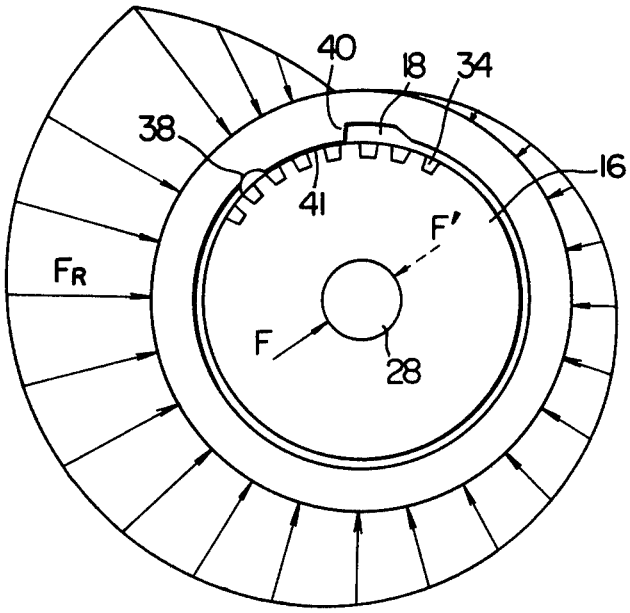
FIG. 3 diagrammatically illustrates the circumferentially unbalanced radially inward forces and the resultant force thereof applied to a shaft of an impeller and also illustrates a counterbalancing force.

As such, the peripheral surface of the impeller 16 is subjected to circumferentially unequal or unbalanced radially inward fluid pressure, as diagrammatically shown in FIG. 3. More specifically, circumferentially unbalanced radially inward leads or so-called "circumferentially unbalanced radial forces" $F_R$ are applied to the impeller 16, as shown in FIG. 3. The resultant force of these unbalanced forces $F_R$ is shown by an arrow F in FIG. 3. This resultant force F is transmitted from the impeller 16 to the shaft 28. Thus, the shaft 28 is subjected to a circumferentially unbalanced radial force acting in substantially the same direction as the direction of the resultant force F and having substantially the same magnitude as the force F.

Figure 4:
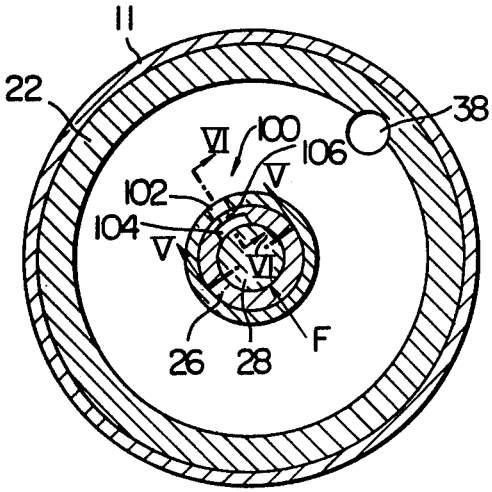
FIG. 4 is a cross-sectional view of the fuel pump taken along line IV—IV in FIG. 1.
Figure 5:
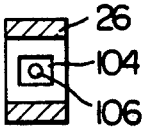
FIG. 5 is an axial sectional view of a bearing taken along line V—V in FIG. 4.
Figure 6:
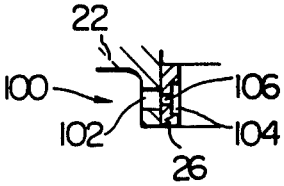
FIG. 6 is a fragmentary axial sectional view of the bearing and a pump housing taken along line VI—VI in FIG. 4.

The pump apparatus according to the present invention, however, is provided with means for applying to the shaft 28 a counterbalancing radial force which is effective to substantially cancelling the circumferentially unbalanced radial force. More specifically, the pump housing inner section 22 which supports the bearing 26 for the motor shaft 28 is formed therein with an opening or through-hole 102 which exposes a part of the outer peripheral surface of the bearing 26 to the interior space within the motor 13, as shown in FIG. 4. On the other hand, a recess 104 is formed in the inner peripheral surface of the bearing 26 and is communicated with the through-hole 102 through a passage or aperture 106 formed in the peripheral wall of the bearing 26. To the part of the peripheral surface of the motor shaft 28 opposed to the recess 104 in the bearing inner surface, therefore, the discharge pressure of the pump 12 is exerted through the through-hole 102, the aperture 106 and the recess 104. Thus, the through-hole 102, the aperture 106 and the recess 104 cooperate to form a pressure introducing opening 100. This pressure introducing opening 100 is provided in the inner pump housing section 22 and the bearing 26 at a point diametrically opposite to the point of the motor shaft 28 at which the resultant force F of the circumferentially unbalanced radial force $F_R$ is exerted to the shaft 28.

By the structure and arrangement discussed above, the discharge pressure of the pump 12 is applied from the space within the motor 13 through the pressure introducing opening 100 to the peripheral surface of the motor shaft 28 to provide a counterbalancing radial force F′ acting in a direction substantially diametrically opposite to the direction of the resultant force F and being of substantially the same magnitude as that of the force F, as diagrammatically shown in FIG. 3. The magnitude of the counterbalancing radial force F′ is adjustable by varying the size of the pressure introducing opening 100.

As will be seen from the foregoing description, the pump apparatus 10 is constructed and arranged such that the resultant force F acting on the motor shaft 28 due to the circumferentially unbalanced radial forces $F_R$ applied to the impeller 16 is cancelled by the counterbalancing radial force F′ applied by the discharge pressure of the pump 12 to the motor shaft 28. Thus, the pump apparatus according to the present invention can be saved from the afore-mentioned prior art problem caused by the circumferentially unbalanced radial forces applied to the motor shaft.

The described and illustrated pump apparatus 10 is a regenerative pump. It is, however, to be noted that the principle of the present invention can be applied to any kind of pumps insofar as the pumps are of the class that utilizes an impeller or rotor.

What is claimed is:

1. A pump apparatus comprising:

a pump means including a pump housing, a shaft and a rotary pumping member rotatably disposed in said pump housing and mounted on said shaft for rotation therewith, said pump housing being formed with circumferential spaced suction and discharge ports;

driving means drivingly connected to said shaft to rotate said rotary pumping member for pumping a fluid;

bearing means rotatably supporting said shaft adjacent to said rotary pumping member;

said rotary pumping member having an outer peripheral section formed with at least one circumferential row of vane grooves, said pump housing cooperating with said section to define therebetween a fluid passage circumferentially extending between and communicating with said suction and discharge ports with a seal between said housing and section circumferentially between the ends of said passage;

the rotation of said rotary pumping member producing in said fluid passage a circumferentially unbalanced fluid pressure which increases along said fluid passage from said suction port toward said discharge port, the circumferentially unbalanced fluid pressure forming circumferentially unbalanced radially inward forces the resultant force of which is applied through said rotary pumping member to a first side of the peripheral surface of said shaft;

counterbalancing means including a pressure introducing opening formed in said bearing means and having an inner end faced to a second side of the peripheral surface of said shaft substantially diametrically opposite to said first side of said shaft;

said counterbalancing means further including means establishing a fluid-flow communication between said discharge port and said pressure introducing opening whereby the discharge pressure of said pump means is applied to said second side of said shaft to form a counterbalancing force.

2. A pump apparatus according to claim 1, further including a casing, and wherein said pump means comprises a regenerative pump, said driving means comprises an electric motor, said regenerative pump and said motor are axially aligned and housed in said casing, said rotary pumping member comprising an impeller mounted on an end portion of the shaft of said motor, said casing being provided with a fluid delivery port, said casing defining therein a space through which said discharge port of said pump housing is communicated with said pressure introducing opening in said bearing means and with said fluid delivery port in said casing.

3. A pump apparatus according to claim 2, wherein said bearing means is supported by said pump housing, said end portion of said motor shaft extends through said bearing means into said pump housing and said impeller is mounted on said end portion of said motor shaft for axial sliding movement relative to said motor shaft.

4. A pump apparatus according to claim 1, 2 or 3, wherein said pump apparatus is used as a fuel pump.

* * * * *